US006158057A

United States Patent [19]

Neumann

[11] Patent Number: 6,158,057

[45] Date of Patent: Dec. 12, 2000

[54] TODDLER TRAINING METHOD

[76] Inventor: Joann Neumann, 220 Hunsell Rd., Newton Square, Pa. 19073

[21] Appl. No.: 09/401,322

[22] Filed: Sep. 23, 1999

Related U.S. Application Data

[60] Provisional application No. 60/121,905, Feb. 26, 1999.

[51] Int. Cl.[7] ..... A41F 9/00

[52] U.S. Cl. ..... 2/312; 2/336

[58] Field of Search ..... 2/69, 312, 80, 2/232, 242, 336, 75, 311, 240, 269, 270, 338, 321; 24/72.1

[56] References Cited

U.S. PATENT DOCUMENTS

| | | | |
|---|---|---|---|
| 475,749 | 5/1892 | Benjamin | 2/232 |
| 478,772 | 7/1892 | Traut | 2/232 |
| 1,076,031 | 10/1913 | Gamble | 2/232 |
| 1,765,965 | 6/1930 | Cohen | 2/311 |
| 2,563,161 | 8/1951 | Dixon | 2/80 |
| 2,588,542 | 3/1952 | Kunz | 2/80 |
| 2,670,471 | 3/1954 | Kaufman | 2/80 |
| 2,697,230 | 12/1954 | Rosecrans, Sr. | 2/308 |
| 2,720,656 | 10/1955 | Allan, Jr. | 2/232 |
| 2,730,723 | 1/1956 | Jonsson | 2/270 |
| 2,869,138 | 1/1959 | Hankoff | 2/311 |
| 2,962,724 | 12/1960 | Wilkens | 2/232 |
| 2,962,726 | 12/1960 | Wehrli | 2/311 |
| 3,238,537 | 3/1966 | Fowler et al. | 2/242 |
| 3,613,679 | 10/1971 | Bijou | 128/169 |
| 4,028,741 | 6/1977 | Henery | 2/232 |
| 4,602,389 | 7/1986 | Brown | 2/243 R |
| 4,698,852 | 10/1987 | Romero | 2/171 |
| 4,783,917 | 11/1988 | Smith et al. | 40/633 |
| 4,825,475 | 5/1989 | Smart | 2/312 |
| 4,999,853 | 3/1991 | Tanner | 2/321 |
| 5,088,128 | 2/1992 | Kape | 2/269 |
| 5,170,505 | 12/1992 | Rohrer | 2/69 |
| 5,214,805 | 6/1993 | Cochran | 2/232 |
| 5,367,714 | 11/1994 | Hines et al. | 2/311 |
| 5,504,944 | 4/1996 | Bromer et al. | 2/269 |

*Primary Examiner*—John J. Calvert
*Assistant Examiner*—Alissa L. Hoey
*Attorney, Agent, or Firm*—Kilpatrick Stockton LLP

[57] ABSTRACT

A novel "method" whereby an infant's over-sized pant legs, that may extend below the infant's feet, are secured above the bottom of the infant's feet to facilitate walking development.

24 Claims, 5 Drawing Sheets

TODDLER TRAINING METHOD

This application claims benefit to Provisional Application 60/121,905 filed Feb. 26, 1999.

BACKGROUND OF THE INVENTION

1. Field of the Invention

The present invention relates to methods for training toddlers to walk and/or for facilitating such training.

2. Description of the Related Art

During the months after an infant enters the world at birth, the infant undergoes a variety of important physical and mental developmental stages. Initially, very basic concepts are learned and fundamental physical development begins. Gradually, the infant's physical development improves until the infant begins to learn how to stand and/or walk for short periods. Learning how to walk is one of the most critical skills and building blocks in child development. For adults, this skill is often taken for granted, but the development of complete walking skills is a gradual process. After an infant's first few steps, there is a long time-period over which a toddler's walking skills develop. An infant's "clumsiness" during this time period can have a variety of effects—from placing the infant's safety at risk to causing frustration for the infant, parent and/or caretaker. It is thus important to enable infants to learn this important skill without outside impositions or limitations that may inhibit the infant's ability to learn this skill.

Despite this need, the present inventor has found that in today's culture, parents unwittingly create an environment that actually inhibits an infant's walking development. Specifically, in our culture, infants or toddlers are often clothed in garments that can actually hamper or retard the development of this skill. Notably, toddlers between the ages of about 6 months and 2½ years (and more notably between about 10 months and 1½ years old) are often clothed in pants or garments having two pant legs with bottom openings through which the infant's feet penetrate. However, with infant's within this age group, it is highly difficult to size pants properly. Unlike adults or older children, as shown in FIG. 1, the pant legs of garments for toddlers in this age group can easily slip or extend beyond the bottoms of the infant's feet. This is due to a variety of factors, such as for example that: 1) parents often purchase over-sized pants to accommodate an infant's high growth rate during this age period; 2) proper pant fitting is more difficult during this age period due to the toddler's smaller size (e.g., children in this age group are often less than 3½ feet tall, or even less than 3 feet tall or even smaller); 3) in order to allow free movement, over-sized clothing is often used for such infants to accommodate an infant's greater physical flexibility; 4) an infant's typical body structure, e.g., small foot size, short legs size and stocky body frame can render proper pant leg fitting problematic. In addition, infants that are beginning to learn walking skills may still spend a considerable amount of time crawling (i.e., moving forward on their hands and knees), which action creates a frictional drag on the infant's pants and can force the pants downwards below the infant's feet.

FIG. 1(A) shows a conventional garment 1 having a pair of pant legs 2 and 3. As shown, the pant legs 2 and 3 have respective openings 2A and 3A through which the infant's feet RF and LF (shown in part in dashed lines) are intended to penetrate. However, as shown in FIG. 1(A), with infants in this age group, such pant legs 2 and 3 may extend well under the bottom walking surface WS of the infant's feet.

For example, as shown in FIG. 1(B), the pant leg 2 can extend such that the rear side 2R of the pant leg 2 lies below the walking surface WS of the infant's foot—e.g., past the heal region H, or past the arch region A, or past the ball region A, or even past the toe region T as shown. In addition, as shown in FIG. 1(B), the front side 2F of the pant leg 2 can extend past the toes of the infant's feet so as to even turn back under the foot RF below the walking surface WF from the front side of the foot RF. Accordingly, the pant leg 2 can substantially inhibit a toddler's walking training and safety therewith. As shown in FIG. 1(A), similar problems can occur with the pant leg 3. As shown in FIGS. 1(A) and 1(B), in contrast to garments for adults and older children, toddler's pant garments can be very baggy. As shown, the diameter between the front side 2F and the rear side 2R of a pant leg can often be greater (and even substantially greater) than the length of the toddler's foot between the back of the heel H and the tip of the toes T, which facilitates undesirable positioning of the pant legs below the toddler's feet.

As a result, by clothing infant's in pants or similar garments, parents have placed substantial limitations upon the development of infant's walking skills. Infant's in this age group (i.e., in the age group in which walking skills are learned) often struggle with falling pant legs that catch below their feet, causing them to fall or the like. At times, pant legs can even extend so far below an infant's feet to even become entangled with each other.

Parents have sometimes rolled up the ends of an infant's pants or tucked the ends of the infant's pants into the infant's socks. But, these methods are inadequate to allow proper and safe development of an infant's walking skills, etc., as discussed above.

In unrelated arts, some devices have been provided having straps proximate a grown individual's legs. U.S. Pat. No. 4,700,406 shows a method of using a plurality of flexible straps in an unrelated art to secure an adult athlete's shin guards. U.S. Pat. No. 2,480,276 shows a cuff for adult trousers having straps 21 and 24 sewn integrally therewith to provide "an ornamental appearance" and to be "useful for outdoor winter wear" (see col. 1, line 6). U.S. Pat. No. 3,411,160 shows an adult's securing means for "securing the free end of . . . trouser legs . . . to obtain a neat appearance without discomfort . . . " (see col. 1, lines 14–17). In particular, the '160 patent provides a method to "blouse" the ends of the pant legs for "military" uniforms. U.S. Pat. No. 2,596,112 shows another trouser blousing method for "paratroopers" uniforms, having a strap 4 with a depending strap 7 that is attached to the paratrooper's boot-top. U.S. Pat. No. 4,393,522 shows an ankle garter having an ankle band 12 and a depending U-shaped stirrup 10 "to narrow and hold the bottom of pants in place so that a sock or boot will fit over it with ease" (see col. 1, lines 5–6). U.S. Pat. No. 2,605,471 shows a sleeping garment with integrally attached feet, which has a reinforcing band 13 integrally attached thereto.

There remains a need for a method to facilitate the development of a toddler's walking skills despite unique problems related to toddler pant legs (e.g., extending below the bottoms of a toddler's feet) which inhibit such development. There also remains a need to preform such a method with a device that can be securely retained and easily used and reused on a consistent, e.g., daily, basis.

SUMMARY OF THE INVENTION

The present invention overcomes the above and other problems in the related art. As discussed herein-below, the present invention provides a novel "method" whereby an infant's pant legs can be secured above the bottom of a infant's feet to facilitate walking.

According to a first aspect of the invention, a method of facilitating walking development of an infant is provided that includes the steps of: a) providing an infant between the ages of 6 months and three years old; b) placing the infant within an over-sized garment having a pair of pant legs with bottom openings for the infant's feet, and providing the garment with the pant legs sized to extend below the bottom of the infants feet even when properly positioned on the infant; c) positioning the pant legs of the garment in a raised position on the infant such that the bottom openings are located above the bottoms of the infant's feet and proximate the infant's ankles; d) providing a walker-strap that consists of a single elongated strap having a first outer layer and a second inner layer having a higher coefficient of friction than the first outer layer, and providing a connecting means for connecting opposite ends of the strap together; e) with the pant legs in the raised position after the step c), wrapping the walker-straps around the lower ends of the pant legs at a position at or above the infant's ankles so that the inner layer of each walker-strap frictionally engages the respective pant leg to retain the pant legs in the raised position without other attachments to the pant legs; and f) having the infant walk with the walker-straps retaining the pant legs in the raised position.

The above and other features and advantages of the present invention will be further understood from the following description of the preferred embodiment thereof, taken in conjunction with the accompanying drawings.

BRIEF DESCRIPTION OF THE DRAWINGS

The present invention is described with reference to the accompanying figures, which are used by way of reference and not limitation, and in which like reference numerals indicate like parts, and in which.

DETAILED DESCRIPTION OF THE PREFERRED EMBODIMENTS

According to the preferred embodiments of the present invention, in order to facilitate the development of an infant's walking skills, the following method steps are preferably utilized.

First, an infant (e.g., between the ages of about 6 months and 2½ years and, more preferably, between about 10 months and 1½ years old) is placed within a garment having pant legs 2 and 3 that may extend substantially under the walking surface WS of the infant's feet.

Figure 1A:
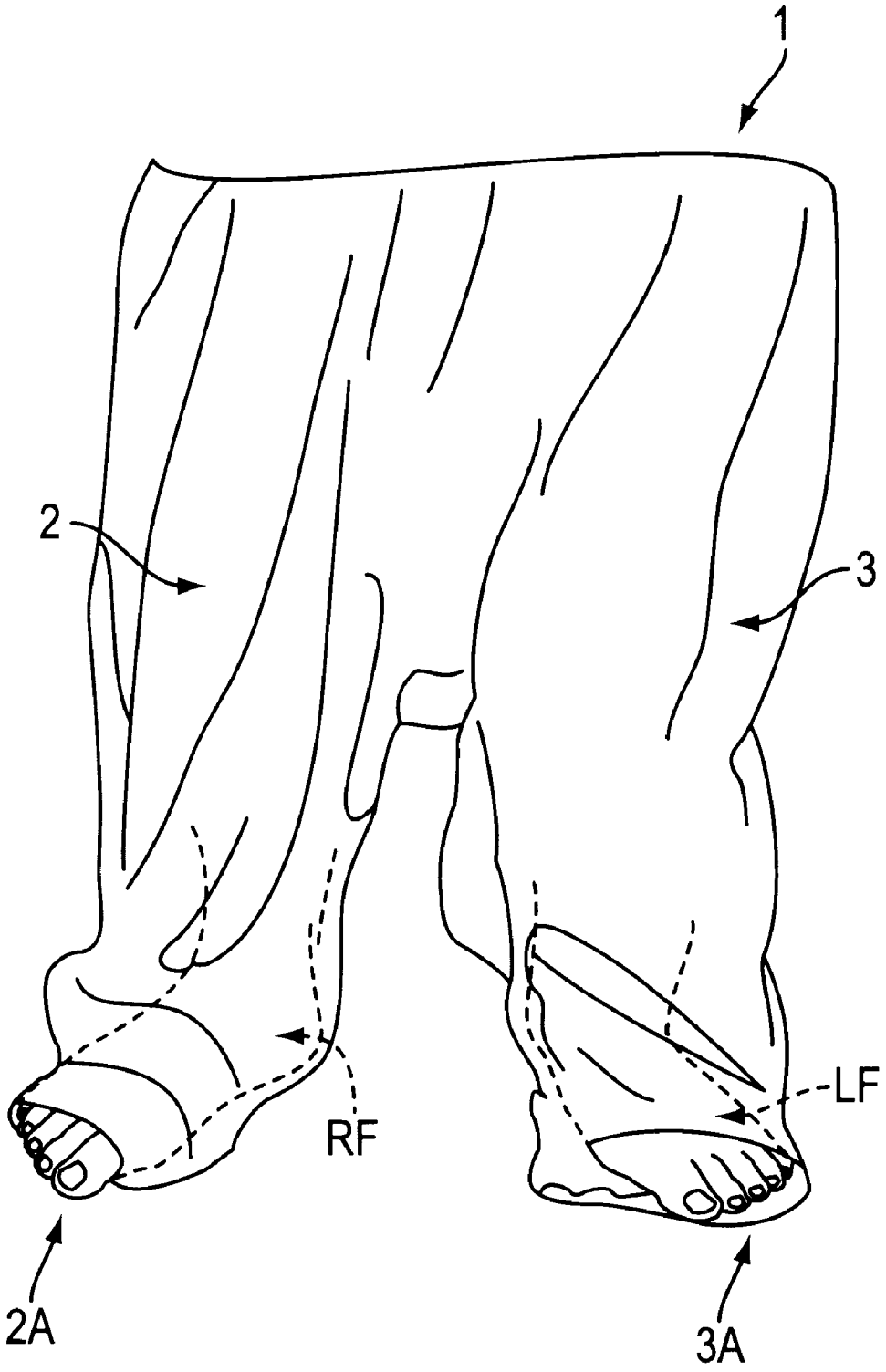
FIG. 1A (PRIOR ART)
FIG. 1(A) shows a partial view of an infant standing within a garment having pant legs that extend below the bottom of the infant's feet according to the prior art.
Figure 1B:
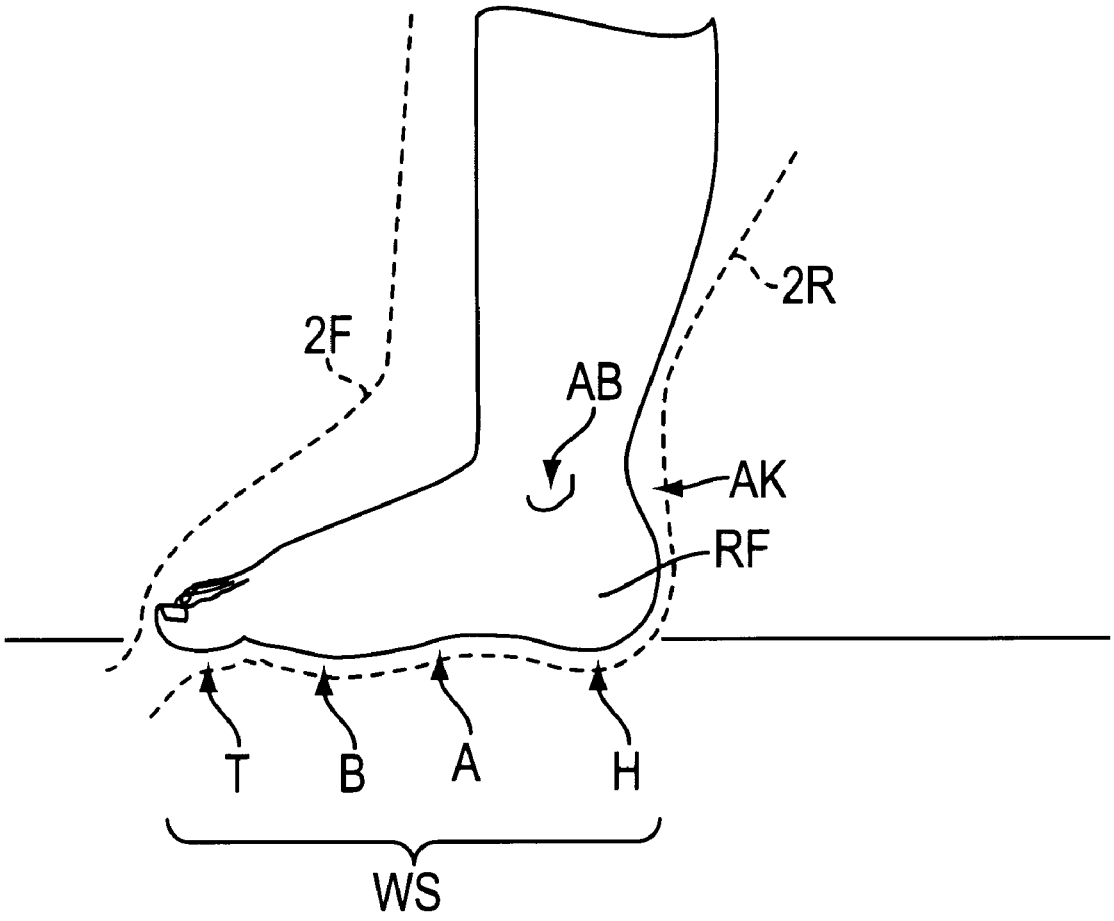
FIG. 1(B) is a schematic side view of an infant's leg within a pant leg that extends below the infant's foot.

Second, the pant legs 2 and 3 are raised such that the bottom openings 2A and 3A of the pant legs are located substantially above the walking surface WS of the infant's feet (e.g., such as at about the ankle level AK, FIG. 1(B), of the infant's feet).

Third, walker-straps 10 are wrapped around the outer lower ends of the pant legs 2 and 3 proximate the openings 2A and 3A (e.g., about ½ inch to 1½ inches above the openings) and the ends of the strap are connected to secure the pant legs in place (without connecting the strap to the pant legs 2 and 3). As discussed below, in the preferred embodiments, the walker-strap 10 has dual layers—i.e., a first outer layer 11 and a second inner layer 12. The outer layer 11 is preferably made of a fabric material (e.g., made with natural or synthetic materials). In some exemplary embodiments, the outer layer 11 can be made with cotton, polyester, nylon, silk and/or other fabric materials. Preferably, the warps and wefts of the fabric material extend parallel to and perpendicular to the length of the strap as shown. In less preferred embodiments, the outer layer 11 can be made with other known materials, such as leather, plastic or other suitable materials. Most preferably, the outer layer 11 is generally non-elastic so that when fixed in place, the opening created cannot vary widely and allow the pant leg to pull out from between the walker-strap 10 and The infant's leg. In less preferred embodiments, however, the outer layer can also be made with elastic materials or elastic portions.

The inner layer 12 is made with a fabric or material having higher gripping qualities than the outside layer 11. The inner layer 12 is an important aspect of the preferred embodiments. The inner layer 12 is preferably made with a material having a high coefficient of friction. The amount of friction should be sufficient to prevent the walker-strap 10 from sliding off the clothing that it is intended to secure. Preferably, the inner layer 12 is made of a natural or synthetic elastomeric material, and is more preferably made of a natural or synthetic rubber. This material is preferably soft and compliant to snugly grip common pant leg fabric materials when wrapped there-around.

In some preferred embodiments, the strength and form of the walker-strap 10 can be maintained by the front layer 11, while the pant leg retaining function can be carried out via the inner friction layer 12. The front and back layers 11 and 12 can be attached to one another with any known attachment means, such as via adhesives, etc. Most preferably, the attachment means includes sewn threads, e.g., around the perimeter edges of the layers, to ensure a secure attachment and to facilitate washing and the like.

The size and shape of the walker-strap 10 is also very important to adequately retain the pant legs 2 and 3 in the preferred embodiments. In order to provide sufficient retention of the pant legs, the width w (see FIG. 3) of the walker-strap 10 is preferably between about ½ and 1½ inches, and is more preferably between about ¾ to 1¼ inches, and is even more preferably about one inch wide. In addition, in order to accommodate infants in this walking development age group, while avoiding excess strap material that could interfere with walking, etc., the length 1 (see FIG. 3) of the walker-strap 10 is preferably between about 7 and 9 inches long, and more preferably about 8 inches long.

Figure 2A:
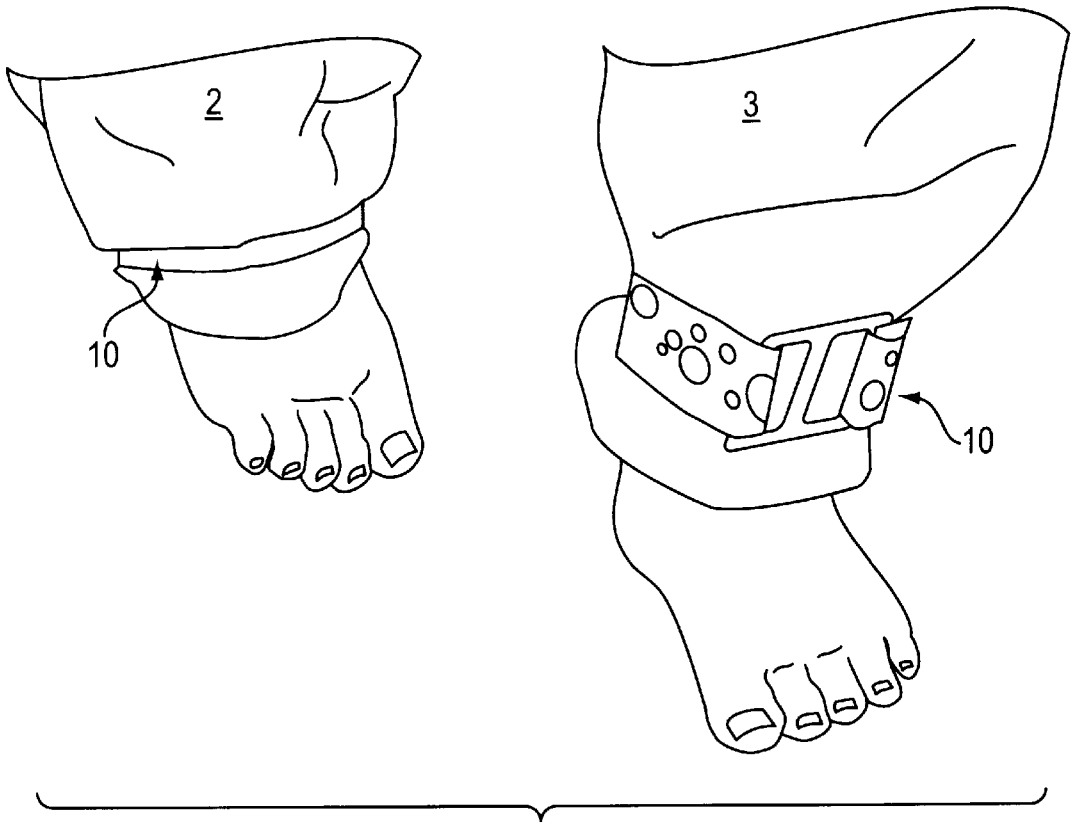
FIGS. 2(A) and 2(B) show partial front perspective views of an infant within a garment like that shown in FIG. 1(A) according to the present method including the provision of walker-straps that raise the pant legs of the garment to facilitate walking development.
Figure 2B:
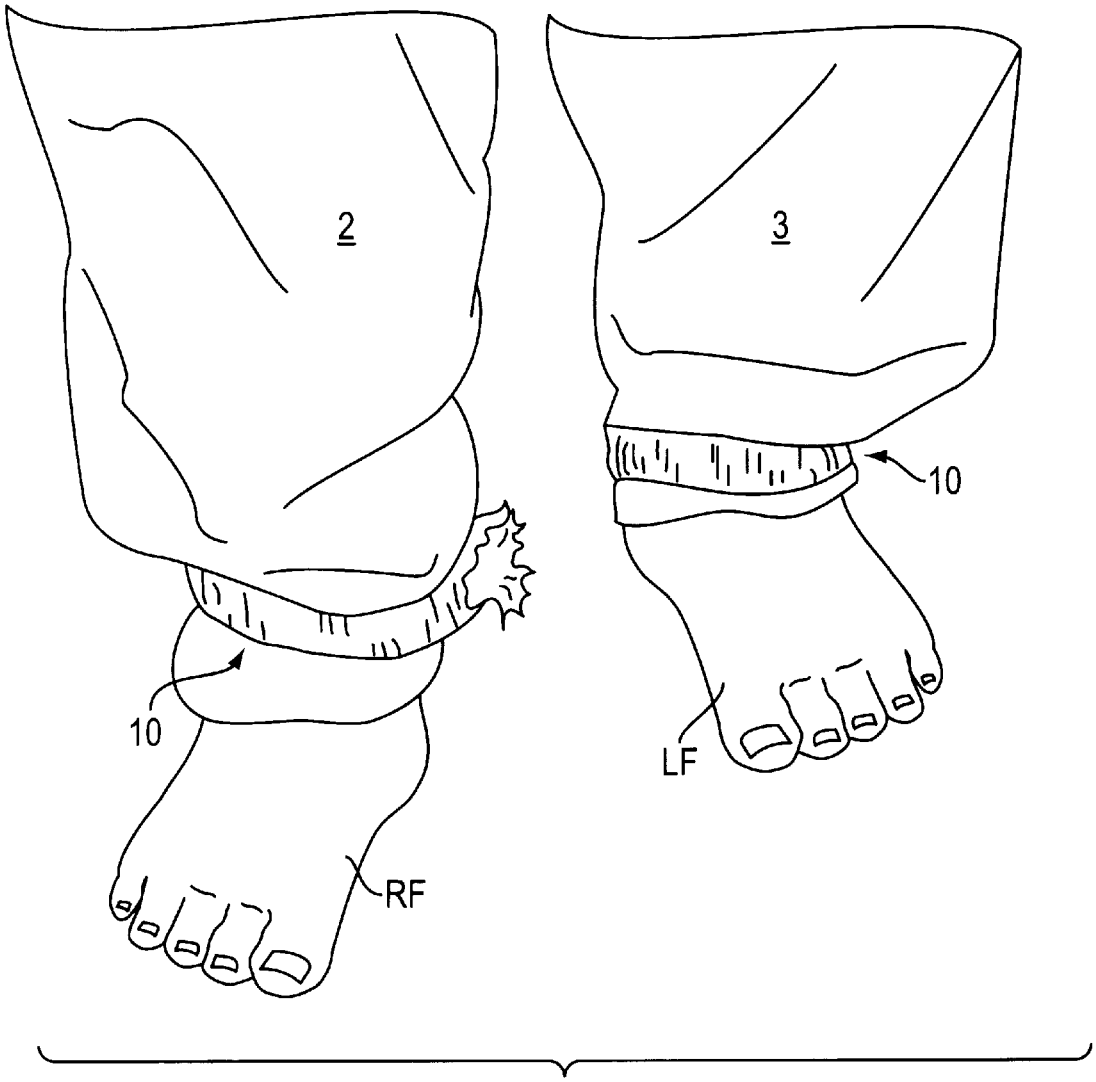

FIGS. 2(A) and 2(B) illustrate a toddler's right and left legs within pant legs 2 and 3 with walker-straps 10 in place as described above. The infant can thus walk freely, with the pant legs 2 and 3 retained in an appropriate position to facilitate walking development.

Figure 3:
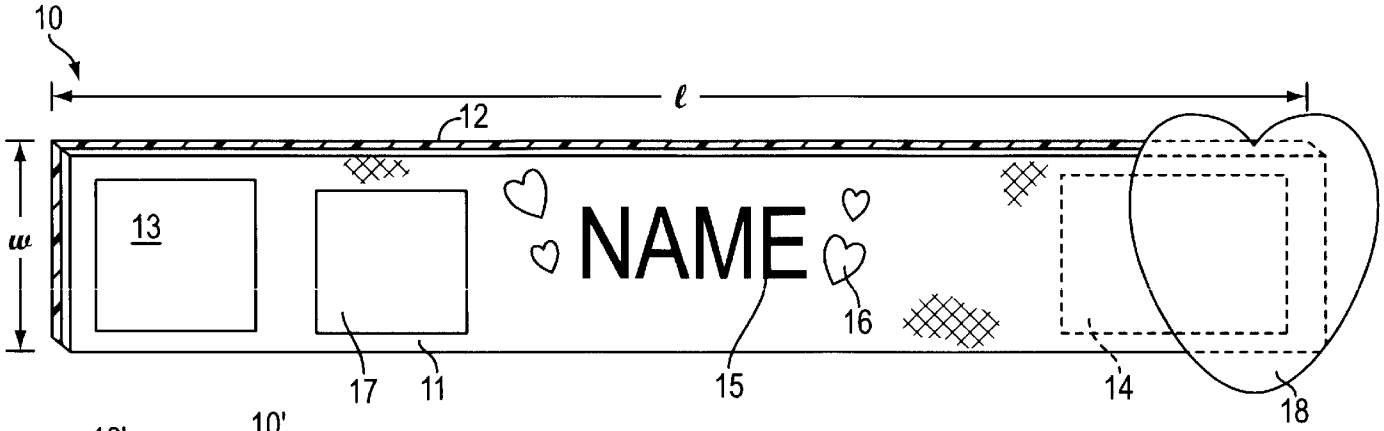
FIG. 3 is a front perspective view of a first embodiment of a walker-strap usable in the method of the present invention.
Figure 4:
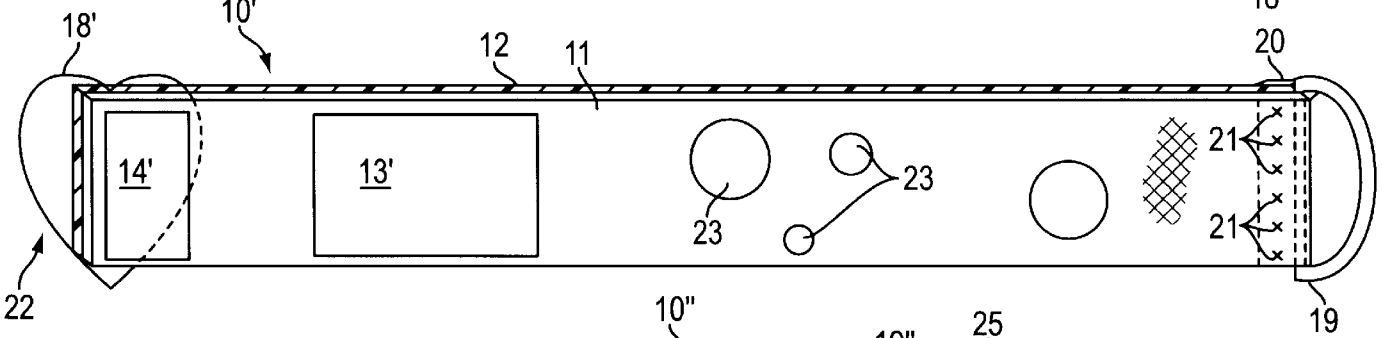
FIG. 4 is a front perspective view of a second embodiment of a walker-strap usable in the method of the present invention.
Figure 5:
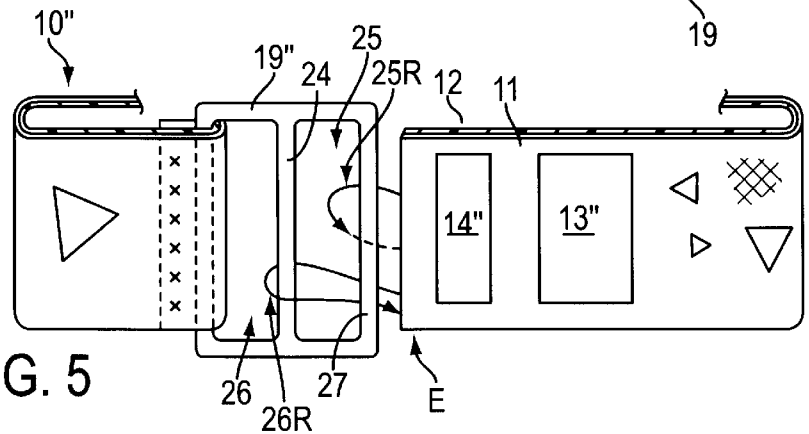
FIG. 5 is a front perspective view of a third embodiment of a walker-strap usable in the method of the present invention.

FIGS. 3–5 show exemplary embodiments of the walker-strap 10 used in the method of the present invention.

FIG. 3 illustrates a first embodiment of a walker-strap 10 having front and back layers 11 and 12 as described above. The front layer 11 has a hook and loop fastening fabric material 13 (e.g., VELCRO™) attached thereto proximate one end, and the rear layer 12 has a corresponding hook and loop fastening fabric material 14 attached thereto proximate the other end (as shown in dashed lines). The walker-strap 10 can be easily wrapped around the infant's pant leg such that the outer layer 11 is exposed and the hook and loop material 14 overlaps and attaches to the hook and loop material 13. In this-manner, the walker-strap 10 can be firmly retained upon the infant's leg.

As also shown in FIG. 3, the outer layer 11 can also include decorative indicia, designs, shapes and/or coloring. The layer 11 can be printed on, dyed, colored, etc., or can include patterns stitched thereto, or can have patterns, etc., formed thereon with other known pattern forming methods. For example, a infant's name 15 or other indicia can be provided. In addition, hearts 16 and/or simple geometric shapes (especially circles, triangles, squares and polygons) can be provided thereon. These decorative additions can be used to enhance an infant's excitement for and/or interest in developing walking skills. In addition, informative markings, such as information related to the proper positioning of the walker-strap 10 and/or the risks of improper placement can be provided thereon to ensure proper use by a caretaker. Similarly, other important information can also be provided, such as emergency phone numbers (e.g., doctor, hospital and parent phone numbers). In this regard, if desired, an information region 17 be provided that: a) contains a transparent pocket attached to the outer surface 11 to accommodate a piece of paper or the like there-behind upon which such information can be written and replaced if needed; or b) can be formed of a material capable of being written on (e.g., with a pencil or pen) to provide such information.

As shown in FIG. 3, additional decorative elements can also be attached to the strap, such as an attached heart-shaped member 18. Preferably, any such attachments do not extend substantially below or outward from the walker-strap 10 so that it cannot interfere with the toddler's walking development (e.g., attachments should clearly not extend below the walking surfaces WS of the foot beneath the walker-strap or the adjacent foot) (e.g., preferably, any attachments extend less than about ¾ inch, and more preferably less than about ½ inch, and even more preferably less than about ¼inch from the surfaces of the walker-strap 10). In the embodiment shown in FIG. 3, the attachment 18 is placed proximate the end of the walker-strap 10. In this manner, the attachment 18 can also serve as a gripping member to facilitate handling and/or can create a more decorative appearance by covering the end of the walker-strap in use.

FIG. 4 shows a second basic embodiment having a walker-strap 10'. As in the embodiment shown in FIG. 3, the walker-strap 10' has front and back layers 11 and 12 like that described above. The main difference between the embodiments shown in FIGS. 3 and 4 are in the manner of attachment. In the device shown in FIG. 4, one end of the walker-strap is connected to a ring or loop 19. As shown, the ring 19 can be attached, as one example, by passing the strap member 10 therethrough, folding it back at 20 and stitching it to the front surface at 21. Although the ring 19 could be made with a rigid material, such as plastic or metal, in a preferred embodiment, the ring 19 is a soft or compliant ring made with fabric or other soft materials (it can also be made to have elasticity). In this embodiment, the front layer 11 preferably has two hook and loop fastening material regions 13' and 14' proximate the opposite end 22 of the walker-strap 10'. To wrap the device around the leg of an infant, the back layer 12 is placed against the pant leg and the end 22 is inserted through the ring 19. Then, the end 22 is turned back such that the hook and loop materials 14' and 13' can be placed in contact with one another and engage to retain the device.

As above, this second embodiment can also include additional indicia, ornamentation and the like. As shown, for example, geometric shapes such as circles 23 can be provided thereon. Similarly, an attachment such as a heart-shaped attachment 18' can also be provided, if desired. As above, such an attachment can be advantageous if placed proximate the end 22 as shown, for reasons similar to that discussed above. Also as above, it is contemplated that additional attachments, indicia and the like can be utilized as long as these attachments do not extend too far from the walker-strap.

FIG. 5 shows yet another embodiment of the invention. The embodiment shown in FIG. 5 is similar to that shown in FIG. 4, except that the ring 19 is replaced with a modified ring 19". As shown, the ring 19" preferably has a generally rectangular perimeter and a central connecting bar 24. The ring can be used in two exemplary ways. First, the end E of the walker-strap 10 can be passed through the right opening 25 as shown by the arrow 25R. Then, the hook and loop materials 14" and 13" can be attached as in the embodiment shown in FIG. 4. Second, the end E of the walker-strap 10 can be passed through the left opening 26 as shown by the arrow 26R and then passed beneath the right member 27 of the ring 19" so that the ring 19" operates to retain the strap via frictional forces against the walker-strap 10. In this case, hook and loop fastening members 14" and 13" can also be provided and utilized similar to as discussed above.

The walker-strap 10, 10' or 10" can thus retain a toddler's pant legs snugly in place. In use, the strap members 10, 10' or 10" are preferably wrapped around the outside of the pant legs 2 and 3 at a location around the toddler's ankles (see AK in FIG. 1(B)) or slightly above the toddler's ankles (i.e., with the strap member slightly above the protruding ankle bones AB, shown in FIG. 1(B)).

The present method allows a toddler or infant to move about without the risks of tripping or getting his or her feet caught inside the toddler's pant legs. The present method is very effective and is also very easy to use and reuse. The preferred embodiments of the walker-strap, used in the preferred embodiments of the present method, having hook and loop fastening fabrics (e.g., VELCRO™) are particularly secure and quick and easy to use. Although hook and loop fastening fabrics are the preferred fastening mechanisms for the walker-strap, a variety of other connecting members can be used. For example, the walker-strap can include a closure at both ends that snaps, clips, buckles or otherwise joins together, or it can include any other known buckle or closure means.

As discussed above, the design qualities of the walker-strap can be aesthetically appealing and can be made to enhance the infant's clothing and/or to blend in therewith. The walker-strap can be plain, colored, quilted, embroidered, personalized and/or enhanced with popular character figures (e.g., cartoon characters and the like), shapes, symbols and/or other designs and attachments. The walker-strap can be designed to enhance an infant's interest in walking. On the other hand, the walker-strap can also be designed so as to avoid distracting the infant.

While the invention has been described in detail above, the invention is not intended to be limited to the specific embodiments described herein. Those skilled in the art may make modifications of and departures from the specific embodiments described herein without departing from the inventive concepts herein as defined by the appending claims. In much less preferred alternative embodiments, walker-straps could be attached directly the pant legs proximate their bottom openings, such as being stitched, buttoned, clipped or the like thereto (e.g., such attachment could be proximate the heal of the infant so that closure of the walker-strap could be effected proximate the front of the infant). Nevertheless, the most preferred, convenient and beneficial embodiments involve unattached walker-straps as discussed above.

What is claimed is:

1. A method of facilitating walking development of an infant, comprising the steps of:

a) providing an infant between the ages of six months and three years old;

b) providing an over-sized garment for an infant between the ages of six months and three years old having a pair of pant legs with bottom openings for feet, and providing the garment with said pant legs sized to extend below the bottom of the feet even when properly positioned on the infant;

c) positioning the pant legs of the garment in a raised position on the infant such that the bottom openings are located above the bottoms of the feet and proximate the ankles;

d) providing two straps that each comprise a single elongated strap having a first outer layer and a second inner layer having a higher coefficient of friction that the first outer layer, and for each strap providing a connecting means for connecting opposite ends of the strap together;

e) with said pant legs in said raised position after said step c), wrapping one of said straps around the lower end of a respective pant leg to a position at or above the infant's ankles so that the inner layer of each strap frictionally engages the respective pant leg to retain said pant legs in said raised position without other attachments to said pant legs; and f) having the infant walk with said straps retaining said pant legs in said raised position.

2. The method of claim 1, wherein in said step of providing straps, for each strap said first outer layer is provided from a fabric material and said second inner layer is provided from an elastomeric material having a higher coefficient of friction.

3. The method of claim 1, wherein in said step of providing straps, each said strap is provided with a width of between about ½ and 1½ inches and with a length of less than about 10 inches.

4. The method of claim 3, wherein in said step of providing straps, each said strap is provided with a width of between about ¾ and 1¼ inches and with a length of less than about 9 inches.

5. The method of claim 1, wherein said connecting means includes hook and loop fastening fabric material.

6. The method of claim 5, wherein said hook and loop fastening material is placed proximate the front and rear ends of the strap and on opposite sides thereof.

7. The method of claim 5, wherein said connecting means includes a ring proximate one end of said strap through which the opposite end passes and is folded over with said fastening fabrics located thereunder.

8. The method of claim 1, wherein said connecting means includes a buckle, a clip or a button.

9. The method of claim 1, wherein said pant leg can extend substantially under the walking surface of the infant's feet when properly placed upon the infant such that the upper end of the garment is properly positioned on the infant.

10. The method of claim 9, wherein a rear side of said pant legs can extend at least to the arch region of the infant's foot even when in said proper position.

11. The method of claim 9, wherein a rear side of said pant legs can extend at least to the ball region of the infant's foot even when in said proper position.

12. The method of claim 9, wherein a rear side of said pant legs can extend at least to the toe region of the infant's foot even when in said proper position.

13. The method of claim 1, wherein said pant legs have a general circular cross-section with a diameter that is larger than a length of the infant's feet from the infant's heel to the tip of the infant's toes.

14. The method of claim 1, wherein said second inner layer extends over the entire inner surface of said first outer layer.

15. The method of claim 14, wherein said second inner layer is sewn to said first outer layer.

16. The method of claim 1, further including the step of providing said first outer layer with colored images.

17. The method of claim 1, wherein said colored images include geometric shapes.

18. The method of claim 1, further including the step of providing indicia on an outer surface of at least one said strap.

19. The method of claim 18, wherein said indicia identifies the name of the infant.

20. The method of claim 18, wherein said indicia identifies emergency information for a caretaker of the infant.

21. The method of claim 1, further including providing at least one decorative attachment to at least one said strap, said attachment extending from said strap a short distance so as not to interfere with walking development.

22. The method of claim 21, wherein said decorative attachment extends over an end of said strap.

23. The method of claim 1, wherein said garment is a pair of pants and said proper positioning involves positioning of a top of said pants proximate the infant's waste.

24. The method of claim 1, wherein said garment is a full body jump suit having a lower pant portion that is integrally connected with a top shirt portion and said proper positioning involves positioning of shoulders of said shirt portion upon shoulders of said infant.

* * * * *